United States Patent [19]

Kossa et al.

[11] 3,934,530

[45] Jan. 27, 1976

[54] TRANSPORT VESSEL FOR FLOATING ONLOADING AND OFFLOADING OF CARGO

[75] Inventors: Miklos M. Kossa, Berkeley; David J. Seymour, Daly City, both of Calif.

[73] Assignee: Inter-Hull, Seattle, Wash.

[22] Filed: Oct. 17, 1974

[21] Appl. No.: 514,859

[52] U.S. Cl. ..... 114/43.5 VC

[51] Int. Cl.[2] ..... B63B 35/28

[58] Field of Search ..... 114/43.5 VC, 45, 47, 72, 114/73, 182, .5 D; 61/64, 65

[56] References Cited

UNITED STATES PATENTS

| | | | |
|---|---|---|---|
| 3,186,369 | 6/1965 | McLenna et al. | 114/43.5 VC |
| 3,191,568 | 6/1965 | Schroeder et al. | 114/43.5 VC |
| 3,299,846 | 1/1967 | Jarlan | 114/.5 D |
| 3,338,205 | 8/1967 | Leavitt | 114/182 |
| 3,793,974 | 2/1974 | Bylo | 114/43.5 VC |
| 3,823,681 | 7/1974 | Cushing et al. | 114/43.5 VC |

*Primary Examiner*—Trygve M. Blix
*Assistant Examiner*—Charles E. Frankfort
*Attorney, Agent, or Firm*—Townsend and Townsend

[57] ABSTRACT

A vessel for transporting floatably onloaded and offloaded cargo (typically barges) is disclosed. A hull having a well deck surrounded on three sides by the bow, port and starboard vessel's sides has a plurality of ballast tanks adapted to be filled with sea water. When the ballast tanks are flooded, the hull is in a loading configuration wherein the well deck is submerged so that cargo can be floated over the well deck and positioned thereon. At this submerged position of the well deck, the continuous sidewalls of the vessel are interrupted by a series of horizontally elongate water level ports constituting a large interruption of the water plane of the vessel. These ports are concentrated in the area of the forward well deck bulkhead and impede the formation of standing waves within the vessel whereby destructive motion between the carrier vessel and the floating cargo can be prevented from damaging the carrier vessel, floating cargo, or both. As the vessel is raised to bring the well deck in contact with the floating cargo, these surge ports are raised above the waterline and no longer communicate the well deck to the sea. Thereafter, communication to the sea for drainage only is provided by vertical freeing ports, constituting a relatively small interruption to the water plane of the vessel.

5 Claims, 3 Drawing Figures

TRANSPORT VESSEL FOR FLOATING ONLOADING AND OFFLOADING OF CARGO

SUMMARY OF THE PRIOR ART

Various designs of carrier vessels which are partially submersible are known. These vessels are partially submersible so that cargo, typically in the form of barges, can be floated onto and off of a carrier vessel. Heretofore, the maintenance of a large, enclosed well deck interior of a vessel filled with water resulted in the establishment of dynamic motion of the water contained within the well deck. The cargo being onloaded or offloaded can only be controlled with difficulty because of the relative motion between the vessel and cargo.

Some solutions have been attempted by doing away with or interrupting the vessel sidewalls. In these latter cases, the longitudinal girder strength fore and aft of the ship is seriously interrupted. Moreover, where discontinuous deck surfaces are provided along the sides of the vessel, the practical operation of a working crew for onloading and offloading cargo barges is not possible.

Finally, and most importantly, it has been found that providing a completely submerged ship side segment permitting the passage of water thereover constitutes a serious interruption of the "water plane" of the vessel. This results in a serious impairment of the reserve roll stability of a vessel, especially when it is being onloaded or offloaded with cargo. In particular, at the moment the well deck is about to rise above the level of the ambient sea, a maximum impairment of its resultant reserve roll stability occurs.

SUMMARY OF THE INVENTION

A vessel for transporting floatably onloaded and offloaded cargo (typically barges) is disclosed. A hull having a well deck surrounded on three sides by the bow, port and starboard vessel's sides has a plurality of ballast tanks adapted to be filled with sea water. When the ballast tanks are flooded, the hull is in a loading configuration wherein the well deck is submerged so that cargo can be floated over the well deck and positioned thereon. At this submerged position of the well deck, the continuous sidewalls of the vessel are interrupted by a series of horizontally elongate water level ports constituting a large interruption of the water plane of the vessel. These ports are concentrated in the area of the forward well deck bulkhead and impede the formation of standing waves within the vessel whereby destructive motion between the carrier vessel and the floating cargo can be prevented from damaging the carrier vessel, floating cargo, or both. As the vessel is raised to bring the well deck in contact with the floating cargo, these surge ports are raised above the waterline and no longer communicate the well deck to the sea. Thereafter, communication to the sea for drainage only is provided by vertical freeing ports, constituting a relatively small interruption to the water plane of the vessel. As the cargo is raised from the floating disposition by the vessel, the roll stability of the vessel becomes critical, these freeing ports providing minimal interruption of the vessel water plane with resultant maximum stability. At the full, deballasted and cargo-carrying disposition of the vessel wherein the well deck is above the waterline, a stern gate water barrier hinged at the back of the well deck is raised to prevent inadvertent cargo floatation due to penetration of following seas while, at the same time, permitting the well deck to drain under the stern gate.

OTHER OBJECTS AND ADVANTAGES OF THE INVENTION

An object of this invention is to provide a stabilizing communication to the sea to prevent standing waves within the enclosed well deck of a submersibly loaded vessel only at drafts where floatation of the interior cargo occurs. According to this aspect of the invention, the vessel sidewalls separating the well deck from the ambient sea is provided with a group of horizontal surge ports constituting at least a 30% communication to the sea.

An advantage of the surge ports of this invention is that where the ports are raised above the ambient water level by deballasting of the vessel, the "water plane" of the vessel is not interrupted to an appreciable degree. As a result, at the point where the cargo is partially supported on the well deck of the vessel and the resultant roll stability of the vessel and supported cargo critical, substantial interference with the water plane of the vessel is avoided. Vessel roll stability is improved.

A further advantage of this invention is to provide sidewalls of the vessel at a normal full height above the ship bottom so that the vessel has a longitudinal girder of full depth. Fore and aft bending strength of the vessel for supporting cargo is improved.

Yet another advantage of this invention is to provide a vessel with a submerged well deck with full and uninterrupted port and starboard working decks for the loading and offloading of barge cargo.

Yet another advantage of the continuous and uninterrupted port and starboard sidewalls of the well deck is that fendering systems for fending off cargo from destructive collision with the vessel sidewalls can be conveniently installed and monitored on a continuous basis. Interruption of the fendering system by correspondent interruption of the vessel sides is avoided.

An additional advantage of the well deck and vessel sidewall construction of this invention is that venting of ballast tanks along the vessel sidewalls is conveniently provided. The provision of separate towers to provide such venting is not required.

A further object of this invention is to disclose a positioning of the surge ports where they will impede to a maximum degree any resonant wave motion interior of the vessel. According to this aspect of the invention, the surge ports are concentrated in the vicinity of the bow of the vessel.

An advantage of this aspect of the invention is that maximum communication to the sea is provided where the standing waves can interfere with the vessel motion and stability, cargo stability, or both, to the maximum extent.

Still a further object of this invention is to disclose a design and configuration of freeing ports. These freeing ports are substantially at and immediately above the well deck of the vessel for draining the well deck through the vessel sidewalls. The freeing ports are given a vertically elongate configuration which impairs to a minimum degree the critical stability of the vessel when it is at a draft with the surface of the well deck on or near the level of the ambient sea.

An advantage of these vertically elongate freeing ports is that water outflow through the sidewalls of the vessel are provided with a minimum of stability impairment. At the drafts where the well deck supports the cargo at or near the ambient water level (and the correspondent roll stability of the vessel is reduced to a minimum), these vertical ports result in minimum interference to the vessel water plane. This minimum interference to the vessel water plane constitutes minimal interference with the critical roll stability of the vessel at such vessel drafts.

Yet a further object of this invention is to provide such freeing ports with a baffle system to impair high velocity flow from the exterior of the vessel into or out of the well deck.

An advantage of this aspect is that drainage during deballasting can occur without high velocity flow into and out of the well deck.

Yet a further advantage of the baffle obstructed freeing ports is that when the vessel is at sea, the water-tight integrity of the interior bay is substantially preserved. Ambient seas cannot appreciably penetrate interior of the well deck to float and dislodge carried cargo where it might damage the cargo, vessel, or both, or otherwise impair the stability of the vessel.

Yet a further object of this invention is to disclose a stern water barrier for protection of the cargo against floating seas. According to this aspect of the invention, a non-watertight gate presenting a barrier to following seas is provided at the stern of the vessel. The gate is drained at its hinge axis over the stern of the vessel between the well deck and the upper portion of the gate.

An advantage of this aspect of the invention is that inadvertent floating of cargo on the well deck due to the penetration of following seas is prevented.

A further advantage of this gate at the stern of the vessel is that drainage of the interior well deck can easily occur between the gate and well deck while the vessel is underway.

Other objects, features and advantages of this invention will become more apparent after referring to the following specification and attached drawing in which.

Figure 1:
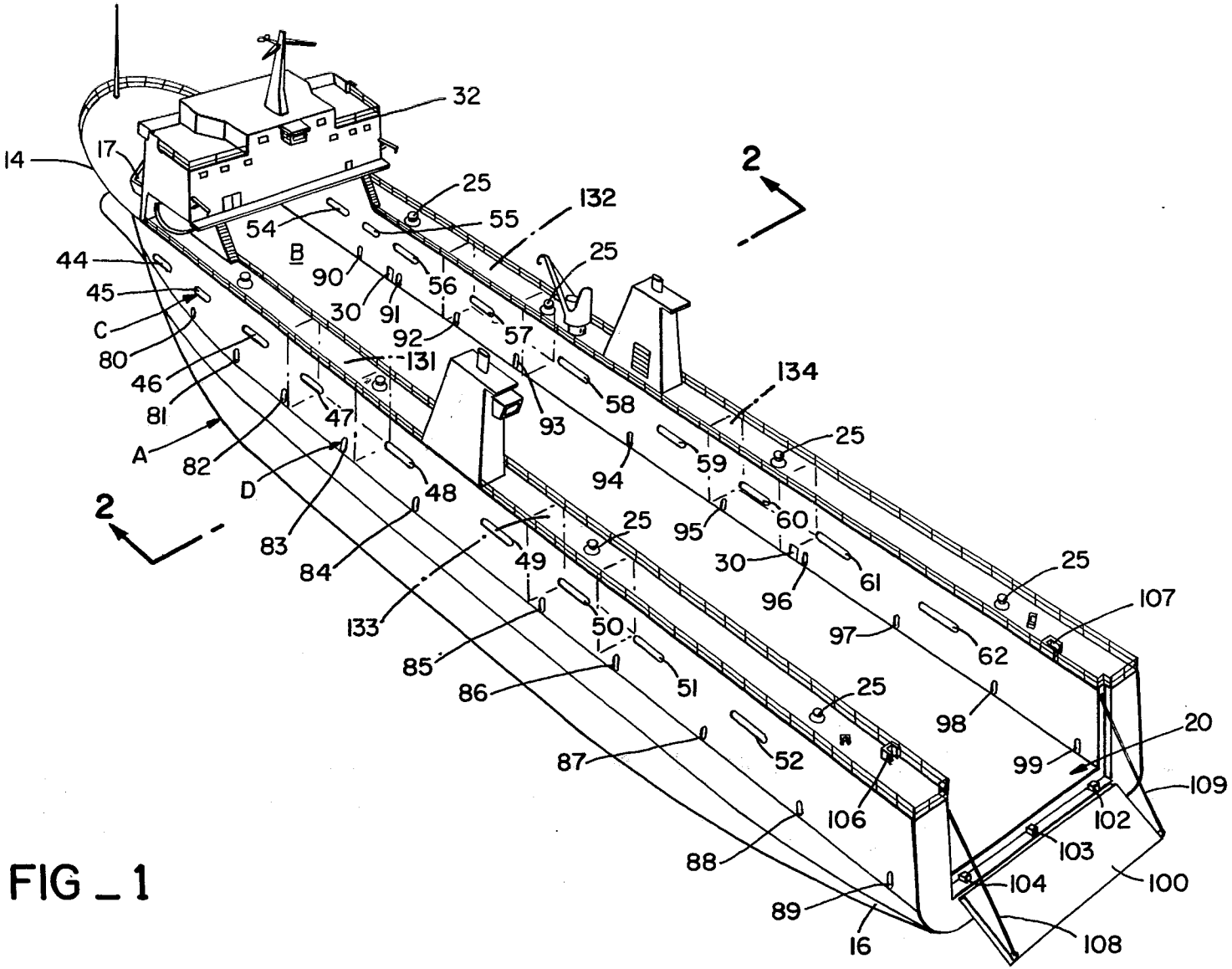
FIG. 1 is a perspective view of the vessel of this invention.

Referring to the perspective view of FIG. 1, hull A is illustrated including bow section 14, stern section 16, with internal well deck B. It will be noted that well deck B is bounded by forward bulkhead 17 at the forward end, port side 18 and starboard side 19, and opened at an opening 20 at the stern of the vessel. It should be noted with reference to FIGS. 1 and 2, that port side 18 defines over the surface thereof a continuous port working deck 21 which extends the full fore and aft length of the vessel. Likewise, starboard side 19 defines thereover continuous working deck 22 which again extends the full length of the vessel. These respective working decks with cargo snugger capstans 25 permit working crews to easily traverse the full length of the vessel on the respective port and starboard sides to enable barges for cargo to be conveniently positioned and landed during deballasting of the vessel.

An internal fender system is provided above the well deck B. Fenders 30 extend along the port and starboard sides of the vessel at preselected intervals to prevent damage to the interior of the bay during the cargo loading and offloading.

Forwardly of the bay and before forward bulkhead 17 of the well deck B is reached, there is provided an elevated superstructure 32. This superstructure is conventional and provides for standard control of the vessel such as steering consoles and engine order telegraph and for housing of crew.

Figure 2:
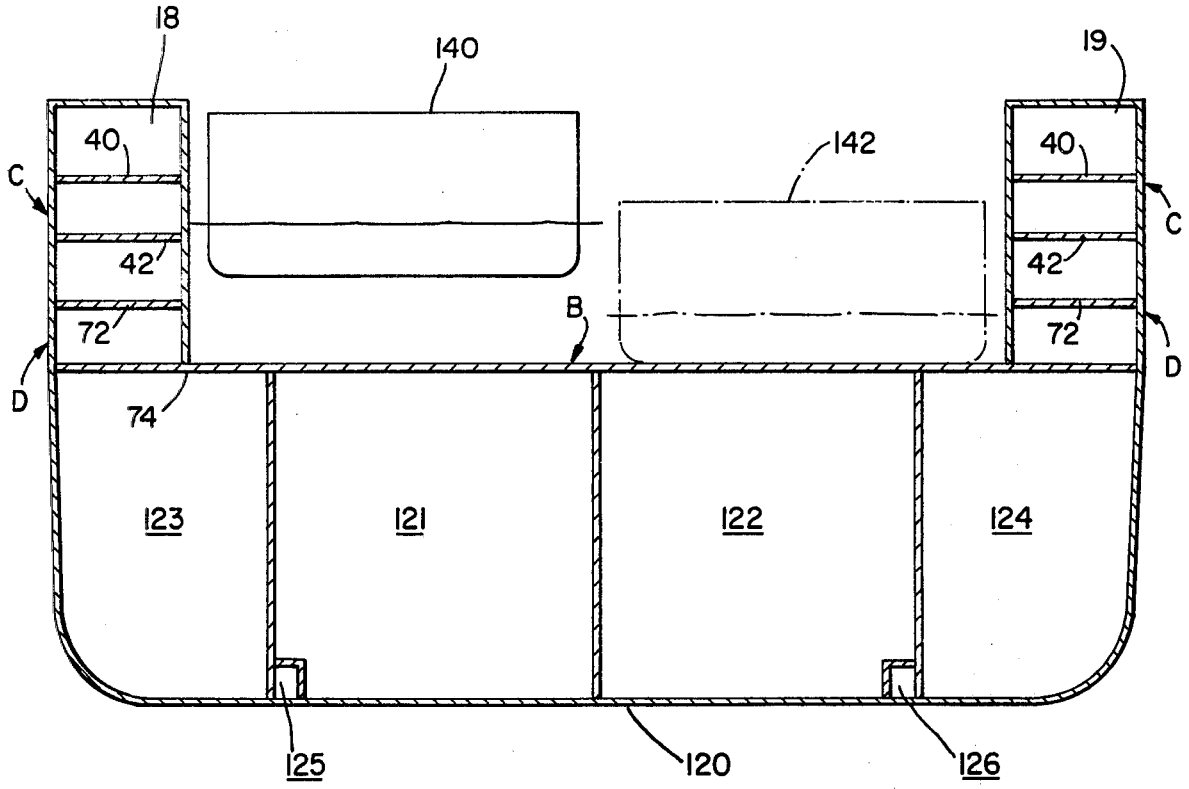
FIG. 2 is a side elevation section of the vessel at an amidships location illustrating floatation of barge cargoes at various vessel drafts; and, FIG. 3 is a plan sectional view of the vessel side in the vicinity of a typical freeing port illustrating the placement of baffles within the port.

Referring to FIGS. 1 and 2 simultaneously, the construction of the surge ports C and the freeing ports D can now be set forth. Referring to surge port C, it will be noted that these ports are horizontally elongate being at least five times as long as they are wide. These respective surge ports are positioned so that the top wall 40 of the surge port lies just above the waterline at the maximum ballasted draft of the vessel.

The bottom of the surge ports 42 is constructed so that if level is at or near the anticipated grounding draft for cargo floated onto the well deck. The bottom surface 42 of the freeing port C is constructed so that some water communication between the well deck B and the exterior of the vessel exists at the anticipated grounding of cargo being floatably onloaded onto the surface of the well deck. Thus, just as the cargo grounds itself on the well deck, the surge ports with decreasing vessel draft will rise above the ambient water level.

Referring to FIG. 1, it will be noted that surge ports 44–52 are positioned along the port side of the vessel. Similarly, surge ports 54–62 are positioned along the starboard side of the vessel.

In the forward one third of the well deck of this carrier vessel, it should be noted that the respective surge ports constitute an interruption of at least 50% of the sidewall surface plane area of the vessel. It is preferred that the interruption of the surge ports constitutes an interruption in the range of 30% to 60% of the sidewall water plane area.

In the mid third of the vessel or amidship third of the vessel sidewall length, the surge ports constitute an interruption of 30% of the water plane. It is preferred that the interruption of the water plane by the horizontally elongate surge ports be in the range of 20% to 40% of the water plane level in the mid third of the vessel.

In the stern third of the vessel's longitudinal sidewalls, the surge ports interrupt 20% of the vessel's water plane. Specifically, it is preferred that interruption here be between 10% and 30% of the water plane at the vessel sidewalls.

Referring to FIG. 2, the construction of freeing ports D can now be set forth. Freeing ports D are vertically elongate, being five times as high as they are wide. As distinguished from surge ports C, these ports D constitute a minimal interruption in the sidewalls of the vessel. Preferably, the ports have an upper limit 72 which is below the lower surface 42 of the surge ports C and transpierce each of the port and starboard sides at a draft wherein the well deck still provides appreciable buoyant support to the cargo. The bottom surface 74 of the freeing port D is flush with the bottom surface B of the well deck.

Figure 3:
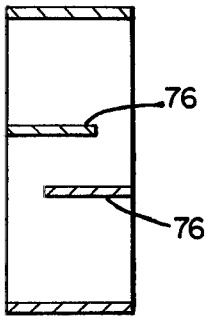

Referring to the top elevation view FIG. 3 of the freeing port D, it is preferred that a system of baffles be placed interior of the freeing port. Baffle 76 functions to inhibit high velocity head flow through the respective freeing ports during loading and offloading. Thus, drainage is permitted, but high velocity surge of water into and out of the well deck is inhibited.

Referring to FIG. 1, surge ports 80–88 are shown on the port side of the vessel; freeing ports 90–98 are shown on the starboard side of the vessel.

At the stern of the vessel there is provided a stern gate 100. Stern gate 100 is provided with hinges 103–104 to the stern section of the vessel. It is raised and lowered by winch 106 on the port side, and winch 107 on the starboard side, through respective cables 108, 109.

It is important to note three separate aspects about gate 100. First, the gate, in the raised position, does not form a watertight barrier. Rather, it is merely a wave barrier against following seas.

Second, the gate, in the vicinity of hinges 102–104, is provided with a drain. Water can freely flow vertically and thereafter under and between the gate 100 and the well deck B to drain the interior of the well deck.

Finally, the gate 100 is not buoyant. This is so in the onloading position it can extend into and under the ambient level of the seas.

Referring to the section of FIG. 2, it will be noted that the distance between well deck B and the bottom 120 of the vessel is occupied by four ballast tanks at the section herein illustrated. Specifically, port ballast tanks 121 and 123 and starboard ballast tanks 122 and 124 are shown. These tanks are provided with longitudinally extending flooding tunnels 125 on the port side and 126 on the starboard side. By the expedient of opening sea cocks (not shown), rapid flooding of the ballast volumes can occur. As is conventional, the ship is equipped with a pump (also not shown) to deballast the vessel.

Provision is made for in excess of 6% reserve buoyancy. Specifically, selected tanks are provided at permanent voids. These voids are incapable of being flooded and are permanently sealed as by conventional shipboard manhole covers and the like. Port voids 131 and 133 are shown by respective broken lines in ship sidewall 18. Similarly, starboard voids 132 and 134 are shown at broken lines in the starboard sidewall 19.

Having set forth the construction of the invention, its operation can now be explained. Referring to the section of FIG. 2, it will be noted that the port side of the figure illustrates the well deck flooded at the maximum draft of the mother ship with a barge cargo 140 fully afloat. The starboard section of FIG. 2 illustrates the vessel at the load line draft with a barge cargo 142 fully drydocked.

Referring to the barge cargo 140 in the afloat disposition, it will be noted that at the fully ballasted down draft of the vessel surge port C communicates across the port sidewall 18 to provide full communication to the ambient sea through the sidewall of the vessel. This communication cuts down standing waves in the interior well deck of the vessel to provide a sheltered and similar water level in the interior of the well deck B as exists in the surrounding and ambient sea.

When the vessel is deballasted, the barge will commence to be drydocked. At this level, the water level on the outside will be at or near the bottom 42 of the surge port C. It should be noted in this disposition that there still will remain substantial floatational forces on the barge 140. Thus, the barge, interior of the well deck B, will contribute to the roll stability of the vessel. The water plane through the vessel will include that plane transpierced by the barge as it rests on the well deck. Thus, the barge itself will contribute to the roll stability of the vessel.

As the vessel is further deballasted, the drydocked barge 140 will approach the condition illustrated at 142. The barge 142 will not contribute to the stability of the vessel. As the ambient waterline approaches the level of the well deck B the roll stability of the vessel will become critical. Typically, the partially flooded hull will have a minimum of stability against roll. Conversely, the barge, which is no longer submerged, will have no floatational resistance to roll. Consequently, the only areas of the vessel providing substantial resistance to roll will be the areas of the water plane penetrated by the respective port wall 18 and starboard wall 19.

It should be noted at this point that the freeing ports 72 being vertically elongate constitute a minimum interruption to the water plane of the vessel at the respective walls 18, 19.

As the vessel is further deballasted, the entirety of the vessel including the well deck will raise above the waterline. At this juncture, the entire cross-sectional area of the vessel will provide roll stability. Well deck D will drain through the respective freeing ports D.

When the vessel is fully deballasted to the loading draft, underway high speed transportation of the cargo can occur.

It should be understood that this vessel can be constructed in any number of actual proportions. By way of example, the dimensions of this vessel are herein set forth. The length overall of the vessel is in the range of 670 feet. The respective well deck has a dimension of 600 feet × 80 feet with the stern gate closed. It is preferred to load the vessel with three barges, the barges being 200 feet long × 80 feet wide. Preferably, the barges are standard flat bottom barges and rest with their respective bottoms on a block (not shown) attached to the well deck. The vessel has a height from keel to well deck of approximately 31.5 feet. The height from the working decks 21, 22 on the sidewalls to the keel is 56 feet.

The full draft of the vessel is 48 feet, giving the respective working decks a 10 foot freeboard above the ambient sea. The load line draft of the vessel is approximately 21 feet, 6 inches, giving the well deck a freeboard of approximately 10 feet against following seas.

It will be appreciated that a number of modifications can be made. For example, it is not required that a stern gate be provided. Likewise, the dimensions and areas of the ports can be altered within the ranges herein disclosed. Likewise, other modifications can be made without departing from the spirit and scope of the invention herein disclosed.

We claim:

1. A vessel for transporting floatably onloaded and offloaded cargo comprising: a hull having a raised bow section for providing buoyant support forward of said vessel at all drafts thereof; a well deck mounted interiorly of said hull extending substantially horizontally parallel to the waterlines of said hull, said well deck adapted to support on said hull said cargo; at least one ballast volume defined within said hull for permitting said hull to float at a first shallow draft when said ballast volume is empty, said ballast volume when empty being of sufficient displacement with respect to said hull to maintain said well deck above the waterline of said vessel with said well deck fully loaded with cargo, and at a second deeper draft when said ballast volume is full of ballast, said well deck submerged at said second draft to provide for floating of the cargo thereover to place said cargo thereon; means for flooding and emptying said ballast volume of ballast; a wall extending upwardly from said well deck at the bottom to a preselected elevation above said well deck, said wall extending from the bow along the port side of the vessel, the starboard side of the vessel, and defining a fixed continuous open passage through the stern of said vessel for the entry and exit of cargo extending substantially the width of said well deck; a series of horizontally elongate ports transpiercing the wall of said vessel; and said ports positioned with respect to said vessel to become partially submerged to establish uninterrupted communcation between the surface of the ambient sea and the surface of the water within said well deck at said second draft to impede the formation of standing waves within the vessel when said vessel is at said second draft and to raise above communication to the sea upon support of said cargo on said well deck.

2. The invention of claim 1 and wherein said horizontally elongate ports interrupt the said wall 30 to 60 percent in the forward third of said vessel, 20 to 40 percent in the middle third of said vessel, and 10 to 30 percent in the aft third of said vessel.

3. The invention of claim 1 and wherein said vessel includes a stern gate for opening and closing said well deck.

4. The invention of claim 1 and wherein said vessel includes a series of vertically elongate ports transpiercing the port and starboard walls of said vessel from an elevation at said well deck to an elevation below said horizontally elongate ports.

5. The invention of claim 4 and wherein said vertically elongate ports contain baffles to impart a circuitous path to water passing between said well and the exterior of said vessel through said vertically elongate ports.

* * * * *